United States Patent [19]

Foster

[11] Patent Number: 4,589,574

[45] Date of Patent: May 20, 1986

[54] DISPENSING PUMP HAVING COLLAR-TO-BODY ANTI-ROTATION INTERLOCK

[75] Inventor: Donald D. Foster, Kingsville, Mo.

[73] Assignee: Realex Corporation, Kansas City, Mo.

[21] Appl. No.: 556,420

[22] Filed: Nov. 30, 1983

[51] Int. Cl.[4] ..... B67B 5/00

[52] U.S. Cl. ..... 222/153; 222/320

[58] Field of Search ..... 222/153, 320, 321, 402.11, 222/402.14, 384, 383, 41, 43, 402, 323, 324; 403/348, 349, 345

[56] References Cited

U.S. PATENT DOCUMENTS

| | | | |
|---|---|---|---|
| 3,179,306 | 4/1965 | Corsette | 222/384 |
| 3,900,123 | 8/1975 | Darlington | 222/153 |
| 4,162,746 | 7/1979 | Anderson | 222/384 |
| 4,278,187 | 7/1981 | Luedtke | 222/384 |
| 4,369,899 | 1/1983 | Magers et al. | 222/153 |
| 4,433,799 | 2/1984 | Corsette | 222/320 |

*Primary Examiner*—Joseph J. Rolla
*Assistant Examiner*—Kenneth Noland
*Attorney, Agent, or Firm*—Schmidt, Johnson, Hovey & Williams

[57] ABSTRACT

Serrations on the upper end of the pump body are disposed for interlocking engagement with depending portions of the pump collar so that when the plunger is rotated in a counterclockwise direction to unlock the same from the collar in preparation for reciprocal operation, the collar is held securely by the body against rotation to assure unlocking. The serrations take the form of a plurality of equally circumferentially spaced ramps which are inclined in the direction of locking rotation of the plunger to thereby permit the collar to yieldably override the serrations when the locked plunger and collar are rotated as a unit in the locking direction relative to the body to orient a spout of the plunger in a desired location for factory packaging efficiency.

5 Claims, 6 Drawing Figures

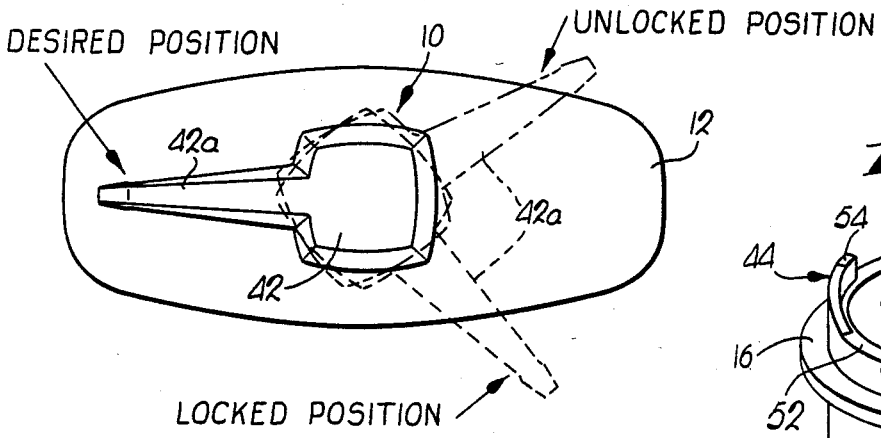
Fig.1.
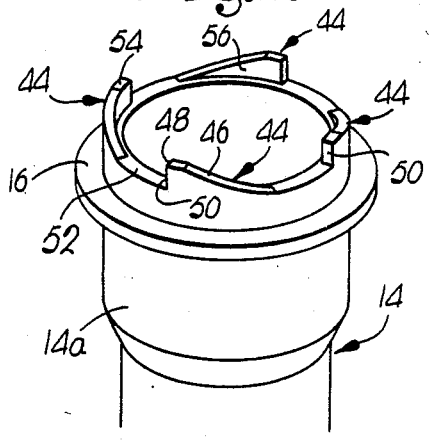
Fig.2.
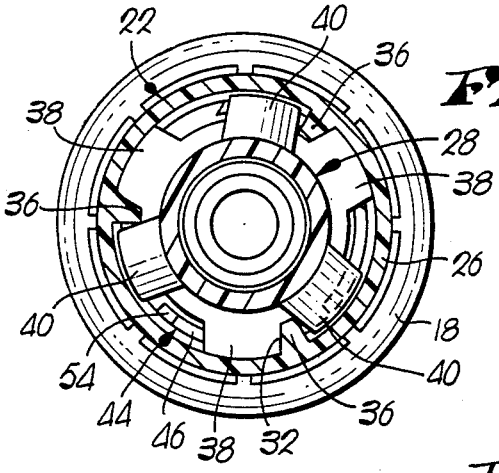
Fig.4.
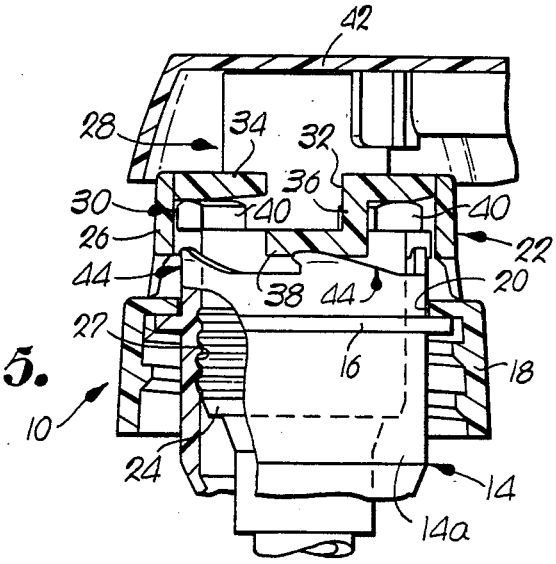
Fig.5.
Fig.3.
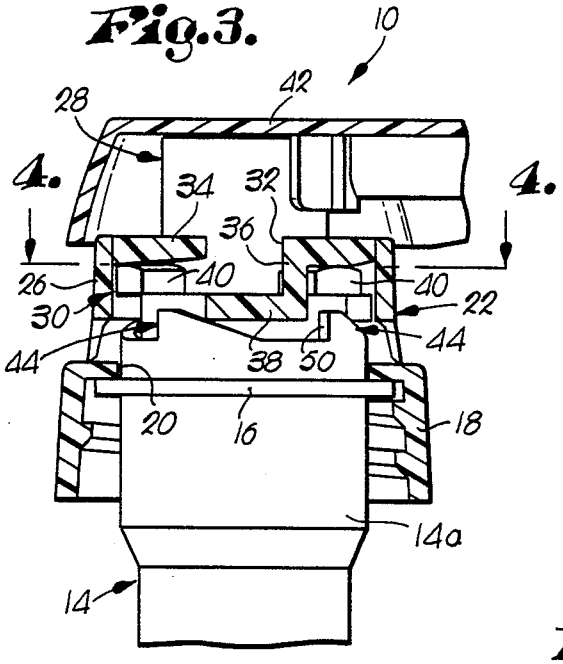
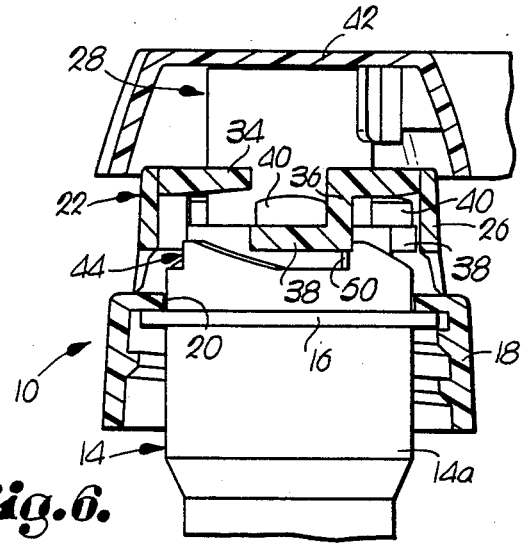
Fig.6.

DISPENSING PUMP HAVING COLLAR-TO-BODY ANTI-ROTATION INTERLOCK

TECHNICAL FIELD

The present invention relates to the field of manually-operated pump dispensers and, more particularly, to improvements relating to the manner in which the plungers of such dispensers may be temporarily locked down in a fully-depressed position for storage, shipment, or other periods of nonuse.

BACKGROUND ART

Conventional pump dispensers typically comprise an assembly of several separate components, including a tubular body defining an interior pumping chamber, a collar which is assembled onto the upper end of the body, and a reciprocal plunger which is received within the body and slides through the collar during operation. Normally, the collar is snap-fitted onto the body using circular beads and grooves which matingly interengage and thus prevent the collar from accidentally pulling free of the body in an axial direction.

Such snap beads and the like are quite adquate insofar as avoiding axial displacement of the collar is concerned, but it has been found that with the advent of down-locking plungers, in which lugs of the plunger may be selectively locked under overhanging structure on the collar, the collar may have a tendency to rotate relative to the body during the locking and unlocking operations, thereby inhibiting the relative rotation between the plunger and collar which is necessary to effectively complete the locking and unlocking movements.

Various attempts have been made to remedy this situation through increasing the interference fit between the collar and body in a radial direction so that the collar is simply more tightly engaged with the body. However, such approaches have not been successful to the desired degree, and thus there is a significant need for a simply, yet effective way of solving this problem.

SUMMARY OF THE PRESENT INVENTION

Accordingly, one important object of the present invention is to provide an anti-rotation interlock between the collar and body which does not rely for its effectiveness upon the dimensional characteristics of the pump and collar in a diametrical sense, but which instead is reliable and effective essentially independently of any radial distortions and manufacturing variations which may typically be encountered. It is a further important object of the invention to provide for such an interlocking arrangement which, while serving as a means for positively stopping the collar from rotation with the plunger during unlocking, is also capable of being overridden in the opposite direction after the plunger has been fully locked down such that, together, the plunger and collar can be rotated in the locking direction to orient the head of the plunger in the most advantageous position for packaging and shipment purposes.

To this end, the upper circular edge of the body is provided with a plurality of serrations in the nature of ramps having surfaces which are inclined upwardly in the direction of locking rotation. Such ramps drop off abruptly at the terminations thereof to provide positive shoulders against which depending portions of the collar may lie when the plunger is rotated in a counterclockwise to unlock the same from the collar. On the other hand, when the container to which the pump is attached is being filled at the factory and it is desired to rotate the plunger in its locked position for orientation purposes, the ramps permit the collar to ride up and over the abrupt stopping shoulders as the collar is rotated in a clockwise direction causing the depending portions thereof to move away from the shoulders.

BRIEF DESCRIPTION OF THE DRAWINGS

FIG. 1 is a top plan view of a container having a pump according to the present invention installed thereon and illustrating, through broken and solid lines, orientation aspects of the plunger;

FIG. 2 is an enlarged, top perspective view of the body illustrating the ramp-like serrations on the top end thereof;

FIG. 3 is a fragmentary illustration of the pump with the plunger in a down and locked position showing parts in cross section and in elevation for illustrative purposes and illustrating a depending locking bar of the collar in an intermediate position between adjacent serrations of the pump body such as might be found to exist during initial lock down of the plunger and prior to orienting rotation thereof;

FIG. 4 is a transverse cross sectional view of the pump taken substantially along line 4—4 of FIG. 3;

FIG. 5 is an elevational and cross sectional view of the pump similar to FIG. 3 but illustrating the way in which the collar may override and partially deform serrations of the body during orienting rotation of the locked-down plunger; and FIG. 6 is another cross sectional and elevational view of the pump similar to FIGS. 3 and 5 but illustrating a depending locking bar of the collar abutted against the shoulder of a serration on the body to prevent unlocking rotation of the collar with the plunger, the plunger in this figure being illustrated in its fully depressed but unlocked position.

DETAILED DESCRIPTION

The pump 10 is adapted for installation onto a container such as the container 12 of FIG. 1 and includes a tubular body 14 provided with an annular flange 16 which rests upon the top edge of the neck finish (not shown) of the container 12. A cap 18 having a central opening 20 permits the upper end of the body 14 to project up through the opening 20 until the flange 16 abuts the bottom of the cap 18 around opening 20. Thus, when the cap 18 is threaded down onto the neck finish, the flange 16 is snugly clamped between the neck finish and the cap 18 so as to securely attach the pump 10 to the container 12.

The pump 10 further includes a collar broadly denoted by the numeral 22 having an inner, tubular shank 24 (FIG. 5) received down into the open upper end of the body 14, and an outer, upper annulus 26 disposed exteriorly of and generally above the upper end of the body 14. Shank 24 is retained in body 14 by circular, interfitting snap beads and grooves 27 and telescopically receives the reciprocal plunger 28 of the pump. The annulus 26 is formed to include a portion of structure which may be broadly referred to as locking means 30 for releasably locking the plunger 28 in a fully depressed position such as shown in FIG. 3, for example. That portion of the locking means 30 found on the annulus 26 takes the form of a series of three equally and circumferentially spaced notches 32, together with overhanging ledges 34 interspersed between the notches 32 and projecting radially inwardly from the periphery of the annulus 26. Axially extending stops 36 are provided at the clockwise end of each ledge 34 between the latter and the shank 24 therebelow, and the annulus 26 is joined radially with the shank 24 by a series of three radially extending abutments or bars 38 disposed at the upper end of the shank 24 and aligned axially below the corresponding notches 32.

That portion of the locking means 30 on the plunger 28 includes a series of three, equally spaced and radially outwardly projecting lugs 40 adjacent the upper end of the plunger 28 a short distance below the depressible actuating head 42 thereof. As will be well understood by those skilled in the art, and as explained in detail in U.S. Pat. No. 4,369,899, assigned to the assignee of the present invention, when the plunger 28 is fully depressed, the lugs 40 may be aligned with the notches 32 to permit the lugs 40 to enter such notches and drop down to a point against the top edge of the shank 24. Rotation of the plunger 28 in a clockwise direction viewing FIG. 4 relative to the collar 22 will then cause the lugs 40 to be slipped under the overhanging ledges 34 such that the plunger 28 is retained in its down and locked position. Unlocking is a simple reversal of this process.

In accordance with the present invention, the upper end of the body 14 is provided with a series of four, ramp-like serrations 44 which cooperate with the bars 38 of the collar 22 to perform an anti-rotation, interlocking function. Each of the serrations 44 includes an inclined surface 46 sloping axially upwardly as the end of the body 14 is traversed in a clockwise direction, and at the termination of each surface 46, an abrupt drop-off 48 is presented to define a shoulder 50 facing in the clockwise direction. The serrations 44 are spaced apart at regular intervals and thus present uninclined, recessed stretches 52 therebetween defined by the upper end extremity of the continuous cylindrical wall 14*a* of the body 14. A flat 54 is provided at the termination of each serration 44 just prior to the drop off 48.

Each of the serrations 44 is flush along its peripheral exterior with the corresponding exterior surface of the wall 14*a* but has an inner arcuate surface 56 which is set back slightly with respect to the inner surface of the wall 14*a*. Thus, the serrations 44 are slightly thinner than the wall 14*a* for the reason that the thickness of the serrations 44 has a bearing upon the ease with which the same may be crushably deformed during plunger orientation which occurs at the factory during filling of the container 12 as will hereinafter be explained in more detail. Preferably, all of the components of the pump 10 are injection molded from a suitable resinous material such as polypropylene which is, to some extent depending upon the configuration into which it is molded, yieldably deformable.

Operation

When the collar 22 is first assembled onto the body 14, it will be randomly placed in any one of a number of rotative positions relative to the body 14. As shown in FIG. 6, for example, as a result of the geometrical relationships between the three bars 38 of the collar 22 and the four serrations of body 14, at least one of the bars 38 is likely to be positioned generally between a pair of the serations 42. As the lugs 40 are inserted into the notches 32 and the plunger 28 is then rotated in a clockwise direction viewing FIG. 4 (if such has not previously been accomplished during assembly of the collar 22 and plunger 28), the plunger 28 should rotate relative to the collar 22 such that the lugs 40 may be brought under the ledges 34 and against their respective stops 36. In the event that the frictional engagement between the beads and grooves 27 is inadequate to hold the collar 22 against rotation with the plunger 28 at this time, the extra frictional engagement between the bars 38 and serrations 44 should be wholly adequate for this purpose. However, even though the plunger 28 and the collar 22 may be thus firmly locked up in the desired manner, the collar 22 might not be in the desired rotative position relative to the container 12 at this time.

For example, when the plunger 28 is in its unlocked position corresponding to that condition illustrated in FIG. 6, the spout 42*a* of the plunger head 42 may be disposed at an approximately two o'clock position, as illustrated in FIG. 1. When the plunger 28 is then fully locked, the spout 42*a* may be disposed in an approximate five o'clock position. However, with the spout thus positioned, it may project outwardly beyond the lateral confines of the container 12, which is not desirable for packaging in the most efficient, space-saving manner. Thus, it is necessary for the plunger 28 and the collar 22 to be rotated substantially in the clockwise direction to bring the spout 42 to its full line position as illustrated in FIG. 1.

During the time that the plunger 28 and collar 22 are driven rotatably during such reorientation, the bars 38 override the serrations 44 by traveling up the sloping surfaces 46. Because of the nature of the resinous material from which the collar 22 on the body 14 are constructed, and as a result of the thickness selected for the serrations 44, there is sufficient yielding action between the bars 38 and the serrations 44 as to permit such rotation of the collar 22 relative to the body 14. As illustrated in FIG. 5, for example, a certain amount of deformation of the serrations 44 may occur at this time.

When a user subsequently desires to unlock the plunger 28, the serrations 44 prevent the collar 22 from moving in the counterclockwise direction with the plunger 28 as the latter is so rotated. Note in this respect that while conceivably there may be a slight amount of counterclockwise rotation of the collar 22 relative to the body 14 during unlocking rotation of the plunger 28, at least one of the serrations 44 will have its shoulder 50 immediately thereafter disposed in blocking relationship to a proximal bar 38 of the collar 22 as illustrated in FIG. 6. Thus, collar 22 may not thereafter rotate further in the counterclockwise direction and the plunger 28 may be quite easily unlocked.

I claim:

1. In a down-locking dispensing pump having a tubular body, a collar at one end of the body provided with means retaining the collar on the body against axial displacement, a plunger reciprocably and rotatably received by the collar and body, and means between the collar and plunger for releasably locking the latter in a fully depressed position relative to the collar, said releasable locking means including a laterally outwardly projecting lug on the plunger adjacent the normally upper end thereof disposed for locking disposition underneath a ledge on the collar when the plunger is fully depressed and rotated in a locking direction relative to the collar, the improvement comprising:

interlocking projection means between said body and the collar for preventing rotation of the latter with the plunger during unlocking rotation of the plunger in a direction opposite to said locking rotation to release said lug from underneath said ledge, wherein said body including a cylindrical wall said projection means including serrations in said wall at said one end of the body engagable with a portion of the collar.

2. In a dispensing pump as claimed in claim 1, wherein said projection means is operable to yieldably permit rotation of the collar with the plunger in said locking direction after the plunger has been locked to said collar in said fully depressed position.

3. In a dispensing pump having a tubular body, a collar at one end of the body provided with means retaining the collar on the body against axial displacement, a plunger reciprocably and rotatably received by the collar and body, and means between the collar and plunger for releasably locking the latter in a fully depressed position relative to the collar, the improvement comprising:

interlocking projection means between said body and the collar for preventing rotation of the latter with the plunger during unlocking rotation of the plunger to release said locking means, said body including a cylindrical wall, said projection means including serrations in said wall at said one end of the body engageable with a portion of the collar, said serrations including at least one ramp having an inclined surface sloping axially outwardly as said one end of the body is traversed in the direction of locking rotation of the plunger whereby to permit said portion of the collar to ride yieldably up said ramp when the plunger is locked in its fully depressed position and the collar and plunger are rotated as a unit relative to the body.

4. In a dispensing pump as claimed in claim 3, wherein said ramp is provided with a drop-off at the termination thereof in the direction of locking rotation, said drop-off defining an abrupt shoulder adapted to be immovably abutted by said portion of the collar during unlocking rotation of the plunger and when said portion of the collar is in position beside said shoulder.

5. In a dispensing pump as claimed in claim 4, wherein four of said ramps are provided on said body at equally circumferentially spaced locations about said one end thereof, said collar being provided with a series of three equally circumferentially spaced abutments defining said body-engaging portion of the collar.

* * * * *